United States Patent [19]

Pellet

[11] 4,353,791

[45] Oct. 12, 1982

[54] HYDROTREATING CATALYST AND LIQUEFACTION OF COAL

[75] Inventor: Regis J. Pellet, Tarrytown, N.Y.

[73] Assignee: Standard Oil Company (Indiana), Chicago, Ill.

[21] Appl. No.: 238,936

[22] Filed: Feb. 27, 1981

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,018,242 | 1/1962 | Gorin | 208/10 |
| 3,433,823 | 3/1969 | McMahon | 252/432 X |
| 3,619,404 | 11/1971 | Riene et al. | 208/10 |
| 3,635,814 | 1/1972 | Riene et al. | 208/10 |
| 3,840,456 | 10/1974 | Yanorsky et al. | 208/10 |
| 4,257,922 | 3/1981 | Kim et al. | 252/461 X |
| 4,294,685 | 10/1981 | Kim et al. | 208/10 |

*Primary Examiner*—Delbert E. Gantz
*Assistant Examiner*—William G. Wright
*Attorney, Agent, or Firm*—William H. Magidson; William T. McClain

[57] ABSTRACT

A coal liquefaction hydrotreating catalyst composition comprising particles of Component A consisting essentially of at least one Group VIB metal component supported on refractory inorganic oxide and particles of Component B consisting essentially of either cobalt and/or nickel component supported on a refractory inorganic oxide.

6 Claims, No Drawings

HYDROTREATING CATALYST AND LIQUEFACTION OF COAL

This invention relates to a process for liquefying coal with a catalyst composition comprising a Group VIB metal component on a support and a Group VIII metal component on a support. More particularly this invention relates to a catalytic composition comprising particles of a component consisting essentially of a Group VIB metal component on a refractory inorganic oxide and particles of a component consisting essentially of nickel and/or cobalt on a refractory inorganic oxide.

Application Ser. No. 020,209, filed Mar. 12, 1979 now U.S. Pat. No. 4,257,922 in the names of Kim, Bertolacini, Gutberlet and Robinson assigned to EPRI discloses new catalysts for the liquefaction of coal comprising preferably a molybdenum component on a bimodal refractory inorganic oxide support which can be optionally promoted with a cobalt component and/or nickel component. While the promoted catalysts have excellent properties for the liquefaction of coal, there is a need for catalysts having higher activity.

As pointed out in the aforesaid application, there are a number of processes which have been described in the literature relating to the hydroconversion of pulverized coal to coal liquid in the presence of molecular hydrogen and a catalyst in a catalytic reactor. In one process, coal conversion involves slurrifying solid pulverized coal in a solvent which is directed through a reactor with the hydrogen gas stream under high pressure and temperature. After conversion, the slurry product is collected. One such process, referred to as the H-Coal process, by Hydrocarbon Research, Inc., is performed in an ebullated catalyst fixed tubular reactor in which the catalyst and coal slurry are suspended and mixed.

The catalyst employed in the above processes includes a variety of catalytically active substances deposited on porous support particles having large surface area. As set out in the background of U.S. Pat. No. 3,635,814, previous investigators have indicated that the pore size for a catalyst is on the order of 50 to 250 angstroms with the most frequent pore size being 60 angstroms. Many of such catalysts are of unimodal distribution, that is, including only one major distribution peak of average diameters of pore volume. On the other hand, there is a product on the market designated HDS-1442A by American Cyanamid Corporation with bimodal pore distribution having a major peak of smaller pore volume distribution (below 600 angstroms) and a second major peak pore volume distribution above 1,000 angstroms.

While my coworkers and I (for example Pellet et al. Ser. Nos. 86,707 and 108,177 now U.S. Pat. No. 4,302,358; and Kim et al. Ser. No. 170,528 now U.S. Pat. No. 4,325,808) have disclosed that there are advantages in using certain specific catalysts having various metal components on different refractory inorganic oxide particles, none of these applications disclose the catalyst compositions claimed herein.

The conversion index referred to below is defined as follows:

$$\text{Conversion Index, C.I.} = \frac{C_c - C_o}{C_R}$$

where $C_c$ = observed conversion with test catalyst at time, t $C_o$ = thermal conversion at time, t $C_R$ = difference between a reference catalyst (Filtrol HPC-5) and thermal conversion at time, t.

The object of this invention is to provide a new class of hydrotreating catalysts. More particularly, the object of this invention is to provide bimodal catalyst compositions having improved properties in the liquefaction of coal. Another object of this invention is to provide a process for liquefaction of coal using improved hydrotreating catalysts. Other objects appear hereinafter.

The objects of this invention can be attained with new hydrotreating catalyst compositions comprising particles of a Component A consisting essentially of at least one Group VIB metal component supported on refractory inorganic oxide and particles of a Component B consisting essentially of either cobalt and/or nickel metal component supported on refractory inorganic oxide. Surprisingly, other things being equal, when metal components of the two types are on different refractory inorganic oxide particles, the catalyst has approximately 10 to 30 percent higher activity for the liquefaction of coal, as measured by the aforesaid Conversion Index. Preferably each of the refractory inorganic oxide supports for the metal components have a bimodal pore distribution of the type set forth in the aforementioned Kim et al. application which is hereby incorporated by reference.

Component A of the catalyst composition of this invention consists essentially of at least one Group VIB metal component on a porous refractory inorganic oxide while Component B comprises either cobalt and/or nickel metal component deposed on a porous refractory inorganic oxide. The Group VIB metals useful in Component A are molybdenum, tungsten and chromium. The concentration of the metal components in the catalyst can range from about 5 to 20 percent of Group VIB metal measured as the oxide and from about 0.5 to 4 weight percent cobalt and/or nickel measured as the oxides. Typically, there can be a weight ratio of about 1:20 to 20:1 of Component A to Component B provided that the catalyst contains the requisite concentration of each metal type. Each of the components of the catalyst composition can be present as free-flowing particles or the free-flowing particles can be composited together into agglomerates containing some particles containing Group VIB metal on refractory inorganic oxide and some particles containing cobalt and/or nickel on refractory inorganic oxide.

Suitable high surface area porous refractory inorganic oxides for use as supports can comprise catalytically active alumina, silica-alumina, silica-magnesia, titania-alumina, zinc oxide-alumina, boria-titania-alumina, mixtures of alumina and silica, mixtures of magnesia and alumina, etc. The refractory oxide should have an average pore diameter of at least 50 angstroms and a surface area of at least 100 square meters per gram. The preferred pore distribution for the catalyst supports of this invention are bimodal. As defined herein and in application Ser. No. 020,209, bimodal distribution means a pore distribution including two major peaks of pore diameters measured as a plot pore volume in cc/gram versus pore diameter or radius. More specifically, in this bimodal distribution, the smaller pores are defined as having peak concentrations being below about 600 angstroms in diameter and the larger pores are defined as being above that value. The average diameter of the smaller pores ranges from about 100 to 200 angstroms, and preferably 100–150 angstroms. The average diameters of the larger pores are in excess of 1,000 angstroms and generally range from 1,000 to 10,000 angstroms. A more preferred size distribution for the smaller pore range is about 120 to 140 angstroms average diameter. In a preferred product, the small pores have diameters predominantly in the range of 70 to 200 angstroms.

Catalyst components of the present invention can be prepared in various ways known to the art. For example, soluble compounds of the various metals can be added to a sol or gel of the refractory inorganic oxide. This composition is thoroughly blended in a sol or gel mixture and subsequently co-gelled by a dissolution of ammonia solution. The resulting co-gelled material is then dried and calcined. In another method, refractory inorganic oxide is gelled, dried, pelleted, calcined and cooled and the resulting material is then impregnated with one or more solutions of the various metal components. If desired various other materials can be added to the catalyst, such as sodium carbonate, boric acid, etc. to control basicity. In general, the more basic the support, the higher the Conversion Index.

For use in ebullated bed reactions the size of the catalyst component particles and composited catalyst agglomerates comprising both particles of Component A and Component B should be small enough to provide the desired contact area during the liquefaction of coal. For use in fixed bed processes the catalyst particles must be substantially larger than the coal particles. In general, it is preferred that the catalyst particles have a size on the order of 60 to 100 mesh (U.S. Sieve Series).

For the purpose of this invention the term "coal" includes any form of solid carbonaceous substance suitable for catalytic conversion, for example, bituminous, semi-bituminous, sub-bituminous grades of coal including lignites, kerogen, peats, semi-anthracite, and the like. Typically, mined coal is pulverized to a size wherein most of the coal solids are less than 8 mesh (U.S. Sieve Series) and typically in the size range of 8 mesh to 325 mesh and typically about 40 mesh.

In a preferred process, the coal is first formed into a slurry before contacting with hydrogen and catalyst. A suitable slurry comprises an organic solvent such as a mixture of mono-, di-, and trimethylnaphthalenes derived from petroleum refining or coal distillates, preferably essentially free of sulfur, nitrogen and oxygen. Because of the difficulties involved in pumping high solids content slurries, a preferred slurry content is generally less than 70 weight percent coal solids based upon the slurry mixture. Suitable concentrations are on the order of 20–70 weight percent coal solids.

In the reaction zone, the coal solids are treated under liquefaction and hydroconversion conditions. The conversion is accomplished in the presence of molecular hydrogen and the catalyst of the present invention. There are a number of known coal liquefaction and hydroconversion processes which employ a hydrogenation catalyst. In each instance, the coal slurry, catalyst and hydrogen are mixed at elevated temperatures and pressures in the reactor. As set out above, in one process, known as the H-Coal process, the pulverized coal slurry is fed to the reactor with hydrogen and catalyst. The reaction is typically performed under ebullated conditions in a fixed bed tubular reactor which contains the catalyst solids. The reactant slurry is recirculated through the reactor in which the coal solids are suspended. Suitable conditions for performing the hydroconversion such as temperature, pressure, flow rates of reactants, charge and the like are well known to those skilled in the art. One catalytic coal conversion process is disclosed in U.S. Pat. No. 3,635,814, the disclosure of which is incorporated at this point by reference.

While the catalysts of this invention are particularly useful for coal liquefaction, they are also useful for upgrading coal liquids by removing sulfur and nitrogen and can be employed in various other hydrotreating processes.

In the examples that follow the bimodal alumina support was provided by W. R. Grace Company, which after grinding to 60 to 100 mesh, had an average pore diameter of 120 Å. By nitrogen desorption down to 20 Å, the support had a surface area of about 160 $m^2/g$, average pore diameter about 110 Å and pore volume of about 0.6 cc/g. By mercury penetration up to $10^5$ Å, the support had a surface area of about 180 $m^2g$, 130 Å average pore diameter and 0.6 cc/g pore volume. Approximately 17 percent of the pore volume was in the range of $10^3$–$10^5$ Å.

EXAMPLE I

This example illustrates the production of the catalyst components and catalysts of this invention. A 3 percent by weight CoO alumina support was prepared by impregnating 50 grams of alumina with an aqueous solution containing 5.8 grams cobalt nitrate dissolved in sufficient water to yield 38 ml of solution, drying overnight at 121° C., and calcining for three hours at 538° C.

A 3 percent by weight CoO, 1 percent by weight Na alumina support was prepared by impregnating 120 grams of alumina with an aqueous solution of 2.8 grams of sodium carbonate dissolved in 96 grams of water, drying at 121° C. and calcining at 538° C., followed by impregnating 50 grams of the product with an aqueous solution containing 5.8 grams of Co nitrate dissolved in sufficient water to yield 38 ml of solution, drying at 121° C. overnight and calcining for three hours at 538° C.

A 3 percent by weight CoO, 2.8 percent by weight B alumina was prepared by impregnating 25 grams of alumina with 4.9 grams of boric acid dissolved in 35 grams of methanol, drying at 121° C. for one-half hour to remove methanol, followed by impregnating 20 grams of product with 2.3 grams of cobalt nitrate dissolved in 20 grams methanol, drying at 121° C. for one-half hour and calcining for three hours at 538° C. The 16 percent by weight $MoO_3$ on alumina was prepared by impregnating 252 grams of alumina with 59 grams ammonium molybdate dissolved in sufficient water to yield 191.5 ml of solution, dried at 121° C. overnight, and calcined for three hours at 538° C.

A five-tenths percent CoO, 16 percent MoO on alumina catalyst control was prepared by impregnating 125 grams of alumina with 2.9 grams of cobalt nitrate and 29.5 grams of ammonium molybdate dissolved in sufficient water to yield 95 ml of solution, dried overnight at 121° C. and calcined for three hours at 538° C.

All the catalyst components and the control were ground to between 60 to 100 mesh.

One part of weight of each of the three cobalt oxide supported aluminum catalyst components was mixed separately with 4 parts by weight of the 16 percent molybdena oxide alumina component.

EXAMPLE II

Each of the three catalyst compositions comprising Component A ($MoO_3$) particles and Component B (CoO) particles in a weight ratio of 1:4 and the control were screened in a stirred autoclave by loading 10 grams of the 60 to 100 mesh catalyst, 150 grams of 60+ mesh Illinois No. 6 coal and 300 grams of donor solvent (Panasol AN-3 trimethylnaphthalene) into a stirred autoclave. The coal slurry was stirred under 2000 psi. hydrogen and the temperature was raised to 400° C. The run length was about 40 minutes after which the reactor was cooled and the product isolated.

The percent conversion was determined indirectly by measuring the amount of benzene insoluble residue in the product which represents unconverted coal, ash and catalyst. The conversion index was then calculated using the formula described above.

The results are set forth below in Table I:

TABLE I

| Catalysts | % Conversion | C.I. |
|---|---|---|
| (0.5% Co 16% $MoO_3/Al_2O_3$) | 80.68 | 1.00 |
| (3.0% $CoO/Al_2O_3$) (16% $MoO_3/Al_2O_3$) | 85.68 | 1.12 |
| (3.0% CoO 1.0% $Na/Al_2O_3$) (16% $MoO_3/Al_2O_3$) | 87.24 | 1.28 |
| (3.0% CoO 2.8% $B/Al_2O_3$) (16% $MoO_3/Al_2O_3$) | 83.10 | 1.09 |

The effective metal loadings for the two catalyst systems are: 0.6% CoO and 12.8% $MoO_3$ as opposed to 0.5% CoO and 16% $MoO_3$ on the control. The above data shows that the catalysts of this invention are from 10 to 30% more active than the control. Further, the conversion index increases as the basicity of the catalyst support increases.

EXAMPLE III

Example II was repeated with essentially the same results using nickel in place of cobalt in the control (C.I. 1.10) and nickel in place of cobalt on neutral alumina (C.I. 1.15).

I claim:

1. In the process of the hydroconversion of coal solids to liquid and gaseous products comprising contacting the coal solids, gas containing molecular hydrogen and catalyst solids in a fuel reaction zone at elevated temperatures and pressures at which a major portion of said coal solids undergo hydroconversion to gaseous and liquid products, the improvement comprising using a hydrotreating catalyst composition comprising particles of Component A consisting essentially of at least one Group VIB metal component supported on refractory inorganic oxide and particles of Component B consisting essentially of either cobalt and/or nickel component supported on refractory inorganic oxide.

2. The process of claim 1 wherein said particles have an essentially bimodal pore distribution with peak concentrations of smaller pores below about 600 angstroms and a peak concentration of larger pores above 600 angstroms, the average diameter of the smaller pores ranging from 100 to 200 angstroms and the average diameter of the larger pores being in excess of 1,000 angstroms.

3. The process of claim 2 wherein the refractory inorganic oxide in Component A and Component B comprises alumina.

4. The process of claim 3 wherein catalyst Component A consists essentially of molybdenum on alumina and catalyst Component B consists essentially of cobalt on alumina.

5. The process of claim 4 wherein the weight ratio of Component A to Component B is from about 1:20 to 20:1.

6. The process of claim 5 wherein molybdenum comprises 5 to 20 percent by weight of the catalyst composition and cobalt comprises from about 0.5 to 4 weight percent of the catalyst composition.

* * * * *